US008105011B2

(12) United States Patent
Winkler

(10) Patent No.: US 8,105,011 B2
(45) Date of Patent: Jan. 31, 2012

(54) FAN COMPRISING A FAN WHEEL

(75) Inventor: Wolfgang Arno Winkler, St. Georgen (DE)

(73) Assignee: EBM-Papst St. Georgen GmbH & Co. KG, St. Georgen (DE)

( * ) Notice: Subject to any disclaimer, the term of this patent is extended or adjusted under 35 U.S.C. 154(b) by 1036 days.

(21) Appl. No.: 11/576,522

(22) PCT Filed: Oct. 1, 2005

(86) PCT No.: PCT/EP2005/010624

§ 371 (c)(1),
(2), (4) Date: Apr. 2, 2007

(87) PCT Pub. No.: WO2006/040031

PCT Pub. Date: Apr. 20, 2006

(65) Prior Publication Data

US 2009/0142191 A1 Jun. 4, 2009

(30) Foreign Application Priority Data

Oct. 9, 2004 (DE) ..... 20 2004 015 896 U
Sep. 29, 2005 (DE) ..... 20 2005 015 357 U

(51) Int. Cl.
*F04D 1/04* (2006.01)

(52) U.S. Cl. ..... 415/71; 416/223 B; 417/424.2

(58) Field of Classification Search ..... 415/71, 415/208.2, 208.3; 416/186 R, 223 B; 417/424.2
See application file for complete search history.

(56) References Cited

U.S. PATENT DOCUMENTS 2,658,455 A * 11/1953 Seinfeld ..... 416/181
3,260,443 A * 7/1966 Garnett et al. ..... 416/182
3,395,649 A * 8/1968 Marischen ..... 415/227
3,984,193 A * 10/1976 Yu ..... 415/228

(Continued)

FOREIGN PATENT DOCUMENTS

DE 32 47 453 12/1983

(Continued)

OTHER PUBLICATIONS

Patent Abs. of Japan, vol. 2000, No. 5, abstracting JP 2000-045 993-A, Hirose+/ Matsush., publ. Feb. 15, 2000 (corresponding to Hirose+ USP 6,592,329, issued Jul. 15, 2003).

*Primary Examiner* — Edward Look
*Assistant Examiner* — Aaron R Eastman
(74) *Attorney, Agent, or Firm* — Milton Oliver, Esq.; Oliver Intellectual Property LLC

(57) ABSTRACT

A fan for cooling a circuit board (26) has a fan wheel (10; 10') that is adapted for rotation about a rotation axis (11) and in a predetermined rotation direction (14), and an outer wall (18) that is rigidly joined to an inner wall (16). Defined between the two walls (16, 18) are curved air-directing conduits (39) that extend from an axial air entrance opening (40) to a radial air exit opening (42). The axial air entrance opening (40) is at a lesser distance from the rotation axis than the radial air exit opening (42), and the air-directing conduits (39) are separated from one another by air-directing blades (30, 32, 34, 36, 38) that each extend, oppositely to the predetermined rotation direction (14), from a point between two adjacent air entrance openings (40) to a point between two adjacent air exit openings (42).

21 Claims, 6 Drawing Sheets

U.S. PATENT DOCUMENTS

| | | | | |
|---|---|---|---|---|
| 4,257,733 | A * | 3/1981 | Bandukwalla et al. | 415/13 |
| 4,643,639 | A * | 2/1987 | Caine | 415/148 |
| 4,767,285 | A * | 8/1988 | Jyoraku et al. | 417/366 |
| 4,802,817 | A * | 2/1989 | Tyler | 415/157 |
| 5,595,473 | A | 1/1997 | Nagaoka et al. | 415/199.1 |
| 6,074,166 | A * | 6/2000 | Moddemeijer | 415/109 |
| 6,371,724 | B2 | 4/2002 | Nagaoka et al. | 415/208.3 |
| 6,592,329 | B1 * | 7/2003 | Hirose et al. | 416/203 |
| 6,814,542 | B2 | 11/2004 | Märländer et al. | 415/219.1 |
| 7,153,097 | B2 * | 12/2006 | Kawabata et al. | 415/206 |
| 2009/0092486 | A1 * | 4/2009 | Higashimori et al. | 415/203 |

FOREIGN PATENT DOCUMENTS

| | | | |
|---|---|---|---|
| DE | 694 32 334 | T2 | 4/1995 |
| DE | 100 20 878 | C2 | 11/2001 |
| DE | 101 22 516 | A1 | 11/2002 |
| EP | 0 666 424 | B1 | 10/1997 |
| EP | 666424 | B1 * | 10/1997 |
| EP | 0 984 167 | | 3/2003 |

* cited by examiner

FAN COMPRISING A FAN WHEEL

CROSS-REFERENCE

This application is a section 371 of PCT/EP2005/10624, filed 1 Oct. 2005 and published 20 Apr. 2006 as WO 2006-40031-A, and claims priority from DE 20 2004015 896.5 and DE 20 2005 015 357.5, the entire contents of which are hereby incorporated by reference.

FIELD OF THE INVENTION

The invention relates to a fan having a fan wheel, which latter can also be referred to as an air-directing wheel.

BACKGROUND

In particular for cooling electronic components that are arranged on circuit boards, a powerful stream of air proceeding approximately parallel to the plane of the circuit board is needed. So-called circuit board fans, such as those shown e.g. by EP 0 666 424 A1, AMRHEIN et al., are used for this. A fan of this kind draws in air by means of its fan wheel in an axial direction, and blows it in a radial direction onto adjacent electronic components in order to cool them.

SUMMARY OF THE INVENTION

It is an object of the invention to make available a novel fan.

According to the invention, this object is achieved by a fan in which curved fan blades define a plurality of helical conduits between respective axial entrance openings and respective radial exit openings. Because the air-directing blades extend, oppositely to the predetermined rotation direction, from the entrance openings to the exit openings, the air pressure in the fan wheel can build up over a longer distance, which is favorable to air output. A configuration of this kind moreover enables, when necessary, a very compact and low design.

Another manner of achieving the stated object is to define a plurality of helical air-directing conduits which each extend over more than one-fifth the entire angular extent of the fan wheel. A fan of this kind is particularly suitable for cooling electrical components on circuit boards.

BRIEF FIGURE DESCRIPTION

Further details and advantageous refinements of the invention are evident from the exemplifying embodiments, in no way to be understood as a limitation of the invention, that are described below and depicted in the drawings.

Figure 4:
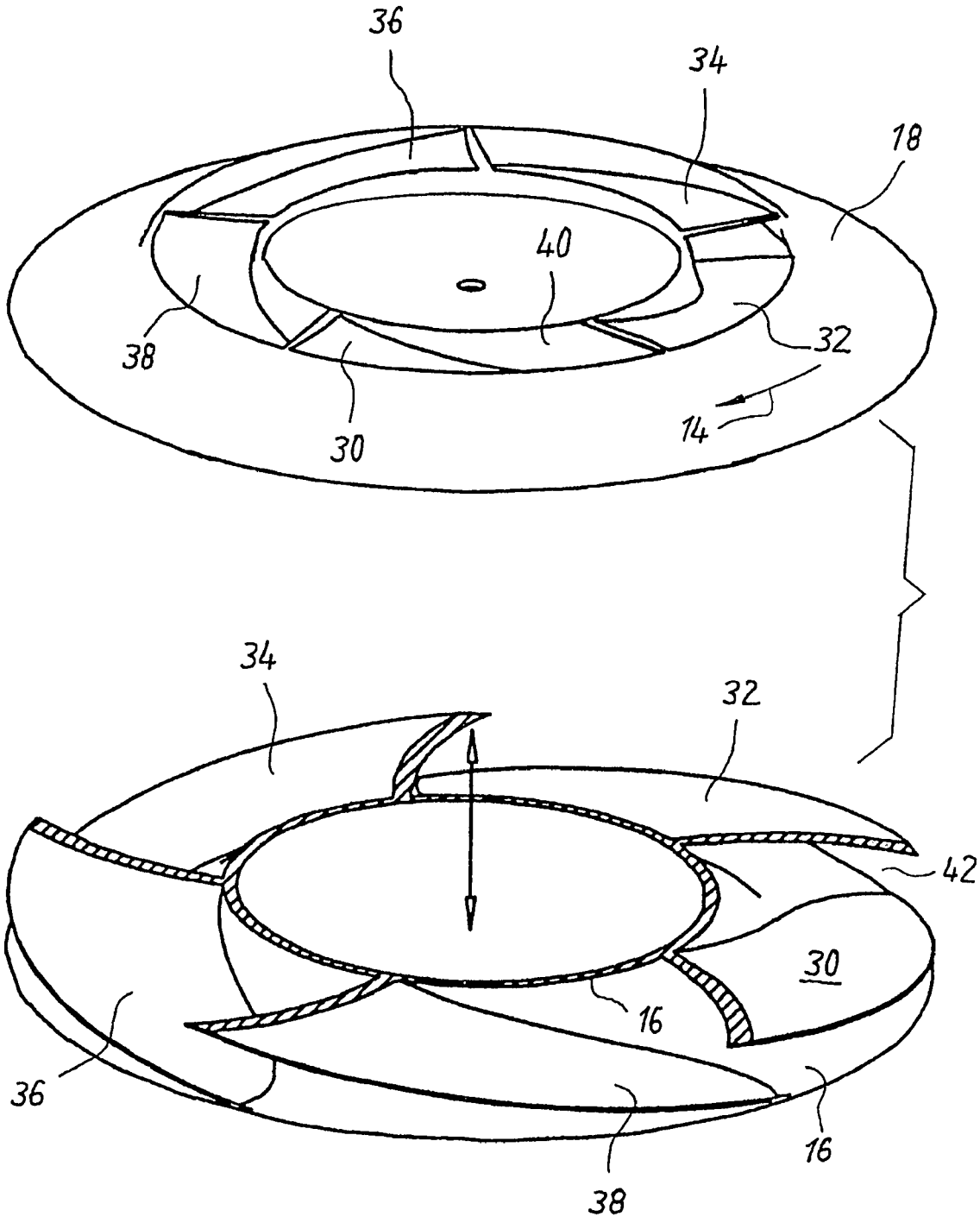
FIG. 4 is a perspective depiction showing a section through the fan wheel of FIGS. 1 to 3, sectioned along a section line that coincides with section line III-III of FIG. 1.
Figure 5:
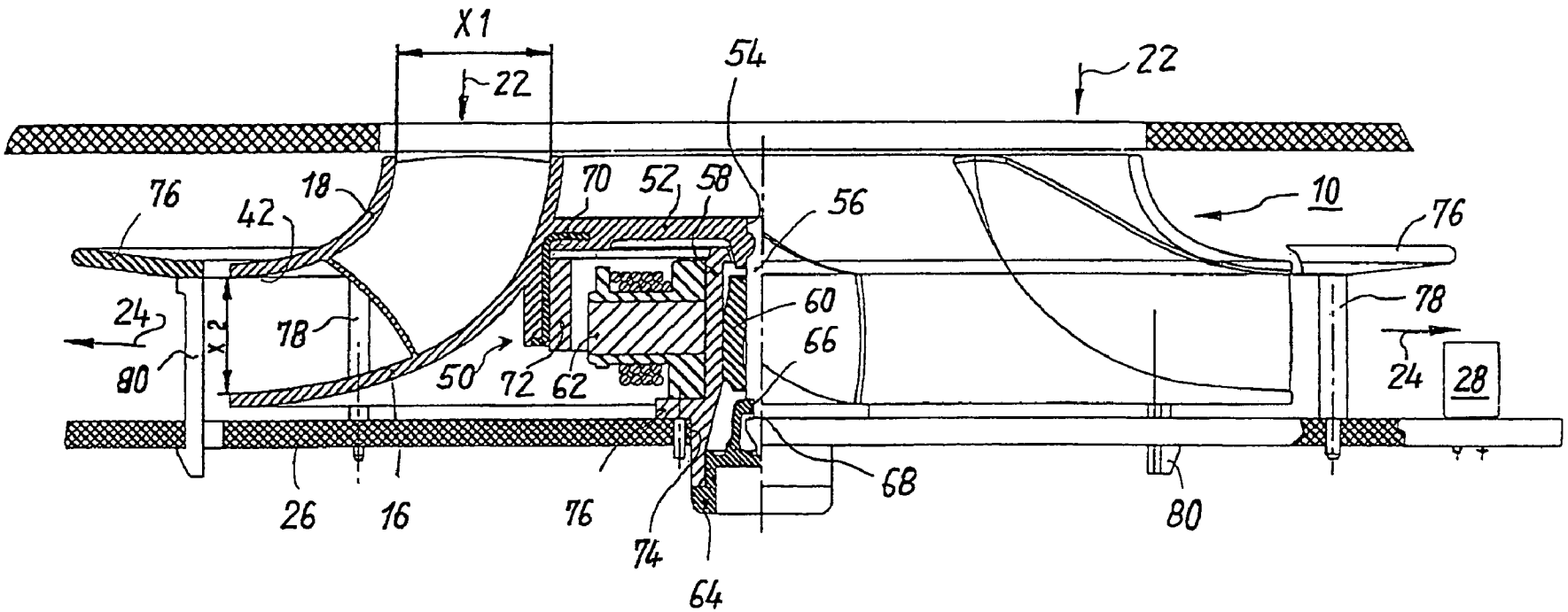
FIG. 5 is a sectioned depiction showing the fan wheel of FIGS. 1 to 4 as part of a fan in the installed state between two plate-shaped components, and enlarged to a scale of approximately 6:1.
Figure 6:
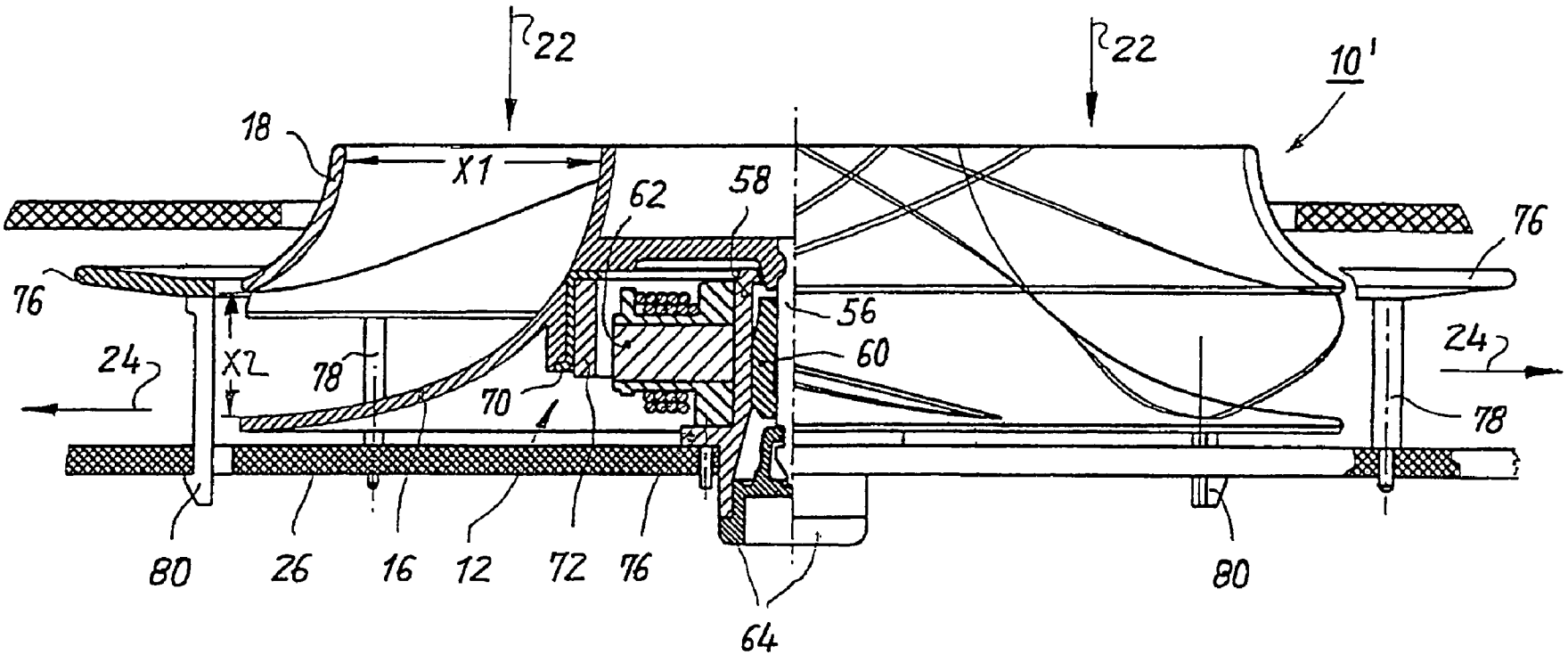
Figure 7:
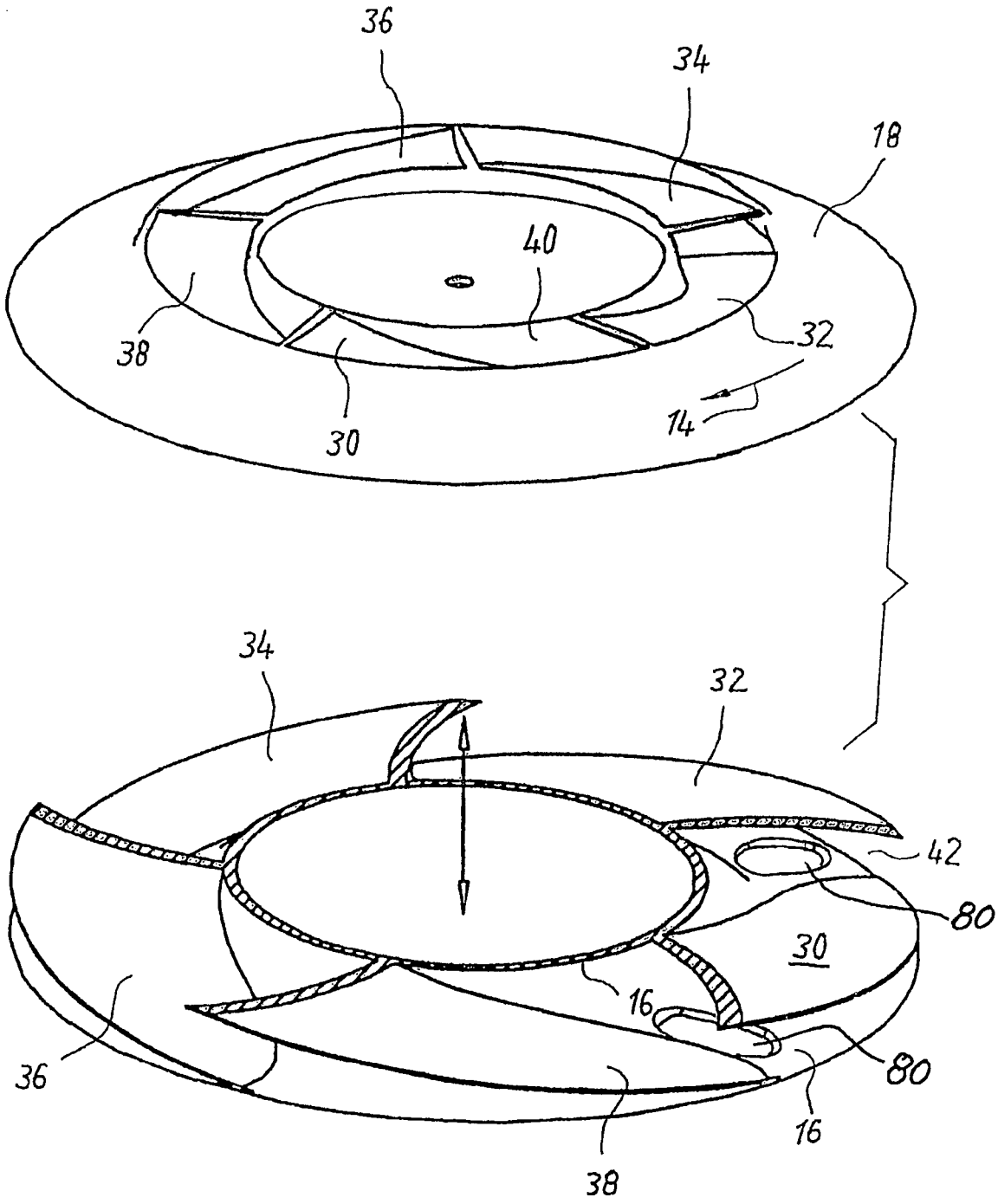

FIG. 6 is a depiction analogous to FIG. 5 showing a variant of the fan wheel, which in this case has a greater axial length and extends with its intake openings through an opening of a circuit board, in order to draw in cool air from the space above said circuit board; and FIG. 7 is a depiction analogous to FIG. 4, in which inner air-directing wall 16 is equipped with orifices 80' through which a portion of the delivered air can flow downward and can there cool components as well as the motor of the fan wheel.

DETAILED DESCRIPTION

Figure 1:
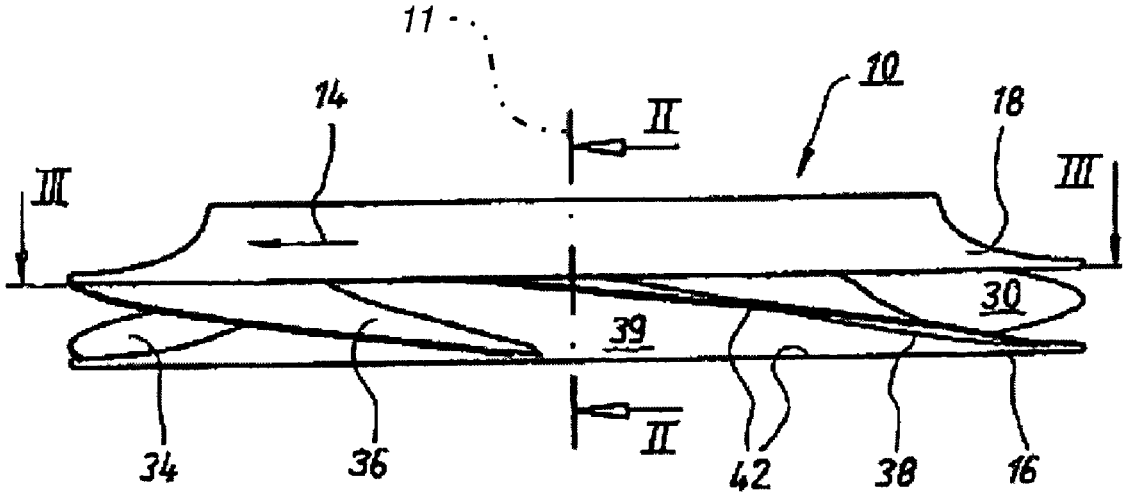
FIG. 1 is a side view of a preferred embodiment of a fan wheel for a fan according to the present invention, at enlarged scale.

FIG. 1 is a side view of fan wheel 10 of a circuit board fan as depicted in FIGS. 5 and 6. Fan wheel 10 rotates during operation in the direction of an arrow 14 in a predetermined rotation direction, about a rotation axis 11. FIG. 6 shows a somewhat differently dimensioned fan wheel that is labeled 10' but corresponds to fan wheel 10 of FIGS. 1 to 5 in terms of its construction and drive system. An electronically commutated external-rotor motor 12, which is depicted in section in FIGS. 5 and 6, preferably serves to drive fan wheel 10.

Figure 2:
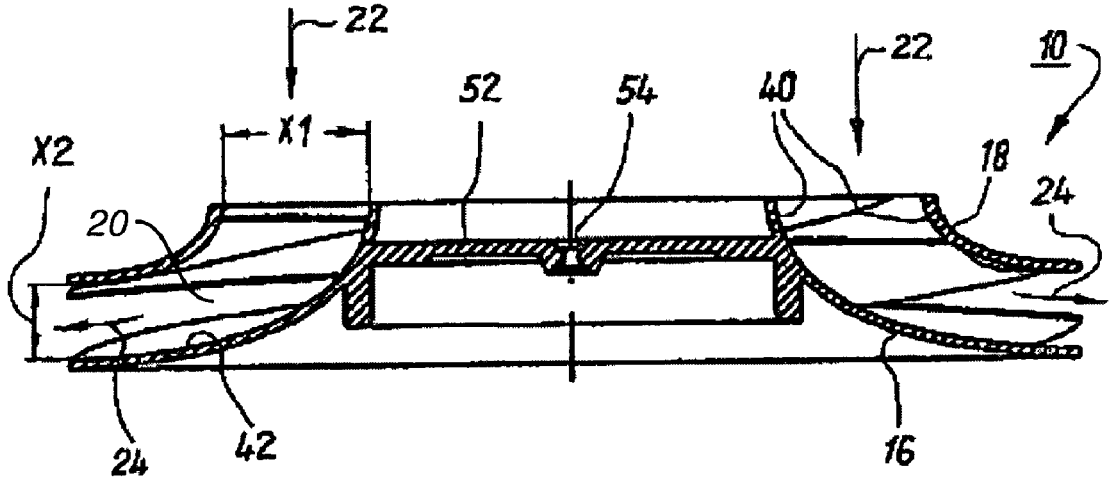
FIG. 2 is a section looking along line II-II of FIG. 1.

As the section according to FIG. 2 shows, fan wheel 10 has an inner air-directing wall 16 that is implemented in concave fashion when viewed from above, and an external air-directing wall 18 that is likewise implemented in concave fashion when viewed from above, the curvatures of air-directing walls 16, 18 being designed so as to yield an air passage 20. During operation, i.e. upon rotation of fan wheel 10, air is drawn into this air passage 20 in the direction of arrows 22, i.e. approximately axially, and this air is blown out again in a radial plane (arrow 24), for example onto electronic components 28 on a circuit board 26, as depicted in FIG. 5. This is therefore a special design of a diagonal fan wheel that deviates greatly from the known designs. Air inlet 40 (dimensional arrow X1) is preferably larger than air outlet 42 (dimensional arrow X2) in order substantially to improve the pressure buildup in fan wheel 10, and thereby the cooling effect.

Figure 3:
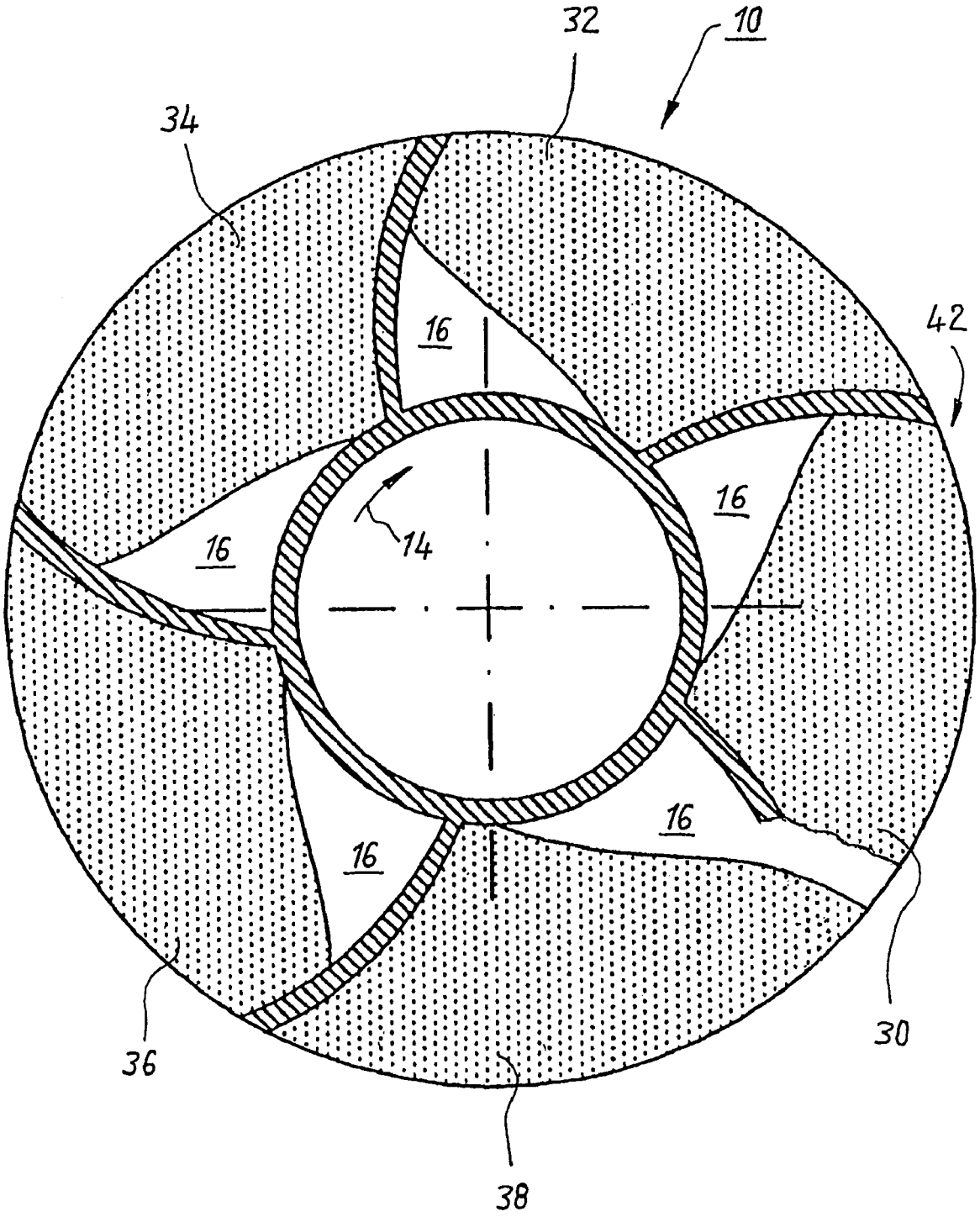
FIG. 3 is a section looking along line III-III of FIG. 1.

The two air-directing walls 16, 18 are joined to one another inside air passage 20 by five air-directing blades 30, 32, 34, 36, 38. In FIG. 3, air-directing blade 30 is depicted in partly cutaway fashion in order to show the entire profile of air-directing blade 38.

The profile of the air-directing blades may be inferred particularly well from FIGS. 3 and 4, which show a horizontal section through fan wheel 10 (along line III-III of FIG. 1).

For example, in FIG. 4 air-directing blade 30 begins at approximately the 7:30 position (with reference to a clock face), extends in the upper part of FIG. 4 oppositely to rotation direction 14 approximately as far as the 5:00 position, and from there extends further, according to the lower part of FIG. 4 and as shown in FIG. 3, to approximately the 2:00 position.

An air-directing blade thus extends, in this example, over approximately 160 to 180° from the inlet to the outlet. As a result, in this example five air-directing conduits 39 are formed, which each begin at an annular-sector-shaped inlet 40 on the upper end face of fan wheel 10 and extend over approximately 180° to an associated outlet 42 on the periphery of said fan wheel 10. This outlet itself has an extension of approximately 120° since the air-directing blades form an oblique delimitation of outlet 42, and has approximately the shape of a parallelogram. In FIG. 1, for example, outlet 42 visible there is delimited by the two air-directing blades 36, 38 and by the two air-directing surfaces 16, 18.

The number of air-directing blades depends on the air flow demand and on the allowable noise emission. If the rotation speed must be low for noise-related reasons, this influences the number of blades required. This number can be optimized by experiment.

The sectioned depiction of FIG. 2 shows, on the inner side of air-directing surface 16, a part 52 of rotor 50. Part 52 is preferably implemented integrally with fan wheel 10 and has in cross section approximately the shape of a shell. Located at its center is an opening 54 for a rotor shaft 56 (cf. FIGS. 5 and 6). A bearing tube 58, into which a sintered bearing 60 is pressed, is provided for journaling of shaft 56. Stator 62 of the motor is pressed onto the outer side of bearing tube 58.

A closure plug 64 is pressed onto the lower end of bearing tube 58, and said plug has resilient prongs 66 that, upon assembly, latch into an annular groove 68 at the lower end of shaft 56 and prevent the latter from being pulled out.

A magnetic yoke 70 is mounted in rotor part 52 as shown in FIGS. 5 and 6, and a rotor magnet 72 that coacts with stator 62 is mounted on said yoke.

For assembly, according to FIGS. 5 and 6, firstly stator 62 is installed on circuit board 26 by the fact that the lower end of bearing tube 58 is pressed into an aperture 74 of circuit board 26 as far as a stop 76'.

An air guidance part 76, which is equipped with support feet 78 and latching feet 80 and is mounted on circuit board 26 in the manner depicted by being latched in, is then mounted around stator 62. Part 76 directly adjoins outlet openings 42 of fan wheel 10. Its distance from circuit board 26 increases in the direction away from stator 62. This part 76 improves cooling and prevents unnecessary eddying of the air at the points where it emerges from fan wheel 10.

Also contributing to improved cooling is the fact that for all air conduits the air inlet opening, symbolized by arrow X1, is larger than the air outlet opening, symbolized by arrow X2. A greater pressure buildup thereby occurs, which substantially improves the cooling effect.

Circuit board 26, on which stator 62 and part 76 are installed, can be transported in this form. At the destination location, fan wheel 10 is mounted by introducing shaft 56 into bearing 60, and by latching resilient prongs 66 in place there. In order to prevent frictional losses, these prongs preferably have no sliding contact with annular groove 86. Assembly of fan wheel at a later time is advisable because shaft 56 has, in practice, a diameter corresponding approximately to that of a knitting needle, so that it could easily bend upon impact. Assembly at the service location of the unit prevents damage during transport.

The construction of motor 12 is the same in the context of FIG. 6 as in FIG. 5, except that fan wheel 10' extends farther upward; this can be advantageous in terms of flow engineering. The air conduits in fan wheel 10' have, in principle, the same helical shape that was described in detail with reference to FIGS. 1 to 5. Part 76 is likewise identical to part 76 that was described in the context of FIG. 5. In FIG. 6 as well, inlet opening X1 is larger than outlet opening X2, in order to achieve good pressure buildup and good cooling.

From what is depicted in FIGS. 5 and 6, it is apparent to one skilled in the art that motor 12, as well as components (not depicted) arranged on circuit board 76 beneath fan wheel 10, are poorly cooled because very little air exchange takes place there.

For this reason, in the variant according to FIG. 7, several orifices 80' are provided in inner wall 16 of fan wheel 10, which preferably are distributed symmetrically in order to prevent imbalances in fan wheel 10. Orifices 80' are each preferably located, as depicted, approximately adjacent to the point at which a vane 30, 32, 34, 36, 38 transitions into the lower (in FIG. 7) part of inner wall 16, so that cooling air is transported through these orifices 80' into the region located between circuit board 76 and inner wall 16 of fan wheel 10. This air, on the one hand, cools motor 12, and, on the other hand, cools electronic components (not depicted) that are arranged there on circuit board 76. The area available on circuit board 76 for population with components is thereby enlarged.

Numerous variants and modifications are of course possible within the scope of the present invention.

What is claimed is:

1. A fan adapted for cooling a circuit board (26), comprising a fan wheel (10, 10') configured for rotation about a rotation axis (11) and in a predetermined rotation direction (14) and formed with an outer guidance wall (18) that is rigidly joined to an inner guidance wall (16), a plurality of curved air-directing conduits (39) being defined between the two walls (16, 18), which conduits each extend in helical fashion from an axial entrance opening (40) to a radial exit opening (42), each axial entrance opening (40) furthermore being at a lesser distance from the rotation axis (11) than a corresponding radial exit opening (42), the air-directing conduits (39) being separated from one another by air-directing blades (30, 32, 34, 36, 38) that each extend, oppositely to said predetermined rotation direction (14), from a point between two entrance openings (40) to a point between two exit openings (42), in order to convert a flow direction of entrained air from an axial flow direction at the entrance opening (40) to a flow direction at the exit opening (42) that is substantially normal to said rotation axis (11), and wherein the inner guidance wall (16) is formed with at least one orifice (80') that enables a cooling air flow from an air-directing conduit (39) through said inner wall (16) of the fan wheel (10), wherein said cooling air flow cools said circuit board (26);

an electronically commutated motor having an external rotor (50), said inner air guidance wall (16) of the fan wheel being coupled, in a central region thereof, to said external rotor (50) via a joining element (52) so that the external rotor (50), in operation, drives the fan wheel (10) in the predetermined rotation direction.

2. The fan according to claim 1, wherein the axial air entrance opening (40; X1) of each air-directing conduit (39) is larger than the radial air exit opening (42; X2) of that air-directing conduit (39).

3. The fan according to claim 1, wherein a transverse dimension (X1) of an axial air entrance opening (40), measured radially with respect to said axis (11), is greater than a transverse dimension (X2) of a radial air exit opening (42), measured parallel to said axis (11).

4. The fan according to claim 1, wherein the cross section of each air-directing conduit (39) decreases substantially continuously from said entrance opening to said exit opening.

5. The fan according to claim 1, wherein the air-directing blades (30, 32, 34, 36, 38) each extend, in a region of the air entrance openings (40), approximately in a radial direction in a space defined between said inner and outer air guidance walls (16, 18).

6. The fan according to claim 1, wherein an air-directing blade (30, 32, 34, 36, 38) extends, in the region between two exit openings (42), from a point on the outer wall (18) located forward with respect to the predetermined rotation direction (14) to a point on the inner wall (16) located farther backward with respect to the rotation direction (14).

7. The fan according to claim 1, wherein there is provided, adjacent to the exit openings (42) of the fan wheel (10), a stationary air-directing member which forms an exit opening that widens in a direction extending away from the exit openings (42) of the fan wheel (10; 10').

8. The fan according to claim 1, wherein at least one of the inner and outer air guidance walls (16, 18) has a concave configuration when viewed from the air entrance side of the fan wheel.

9. The fan according to claim 8, wherein both of said inner and outer air guidance walls (16, 18) have concave configurations, viewed from said air entrance side.

10. The fan according to claim 1, wherein the inner air guidance wall (16) is equipped, in its central region, with a joining element (52) which couples to an external rotor (50) of an electronically commutated external-rotor motor (12).

11. The fan according to claim 10, further comprising a soft ferromagnetic yoke part (70), on which a permanent magnet (72) of the external rotor (50) is arranged, embedded in the joining element (52).

12. The fan according to claim 10, wherein a shaft (56) of the motor (12) is mounted in the joining element (52).

13. A fan for mounting on a circuit board (26), comprising a fan wheel (10; 10') that is adapted for rotation about a rotation axis (11) and in a predetermined rotation direction (14) and has an outer wall (18) that is rigidly joined to an inner wall (16), curved air-directing conduits (39) defined between said inner and outer walls (16, 18), which conduits each extend from an axial air entrance opening (40) to a radial air exit opening (42), of which the axial air entrance opening (40) is at a lesser distance from the rotation axis (11) than is the radial air exit opening (42), and the air-directing conduits (39) being separated from one another by air-directing blades (30, 32, 34, 36, 38) that each extend, oppositely to the predetermined rotation direction (14), from a first point between two adjacent air entrance openings (40) to a second point between two adjacent air exit openings (42), an angular distance or extent, between a transition point from an air-directing blade (30, 32, 34, 36, 38) to the inner wall (16), measured at that air-directing blade between said first point and said second point, being greater than one-fifth of a complete angular extent of the fan wheel (10; 10'), and wherein the inner wall (16) is formed with at least one orifice (80') that enables a cooling air flow from an air-directing conduit (39) through said inner wall (16) of the fan wheel (10), wherein said cooling air flow cools said circuit board (26).

14. The fan according to claim 13, wherein the angular distance is greater than one-fourth of a complete angular extent of the fan wheel (10; 10').

15. The fan according to claim 13, wherein the angular distance is approximately 160° to approximately 180°.

16. The fan according to claim 13, wherein the axial air entrance opening (40; X1) of each air-directing conduit (39) is larger than the radial air exit opening (42; X2) of that air-directing conduit (39) connecting from said entrance to said exit.

17. The fan according to claim 13, wherein a transverse dimension (X1) of an axial air entrance opening (40) is larger than a transverse dimension (X2) of a radial air exit opening (42).

18. The fan according to claim 13, wherein the cross section of an air-directing conduit (39) decreases substantially continuously from said entrance opening to said exit opening.

19. The fan according to claim 13, wherein the air-directing blades (30, 32, 34, 36, 38) extend, in the region of the air entrance openings (40), approximately in a radial direction in a space defined between the two air guidance walls (16, 18).

20. The fan according to claim 13, wherein an air-directing blade (30, 32, 34, 36, 38) extends, in the region between two air exit openings (42), from a point on the outer wall (18) located forward with respect to the predetermined rotation direction (14) to a point on the inner wall (16) located farther backward with respect to the rotation direction (14).

21. The fan according to claim 13, further comprising an electronically commutated motor having a rotor (50) and wherein the inner wall (16) of the fan wheel (10) is coupled to the rotor (50) of said electronically commutated motor (12) that, in operation, drives the fan wheel (10) in the predetermined rotation direction (14).

* * * * *